US007249014B2

(12) United States Patent
Kannan et al.

(10) Patent No.: US 7,249,014 B2
(45) Date of Patent: Jul. 24, 2007

(54) APPARATUS, METHODS AND ARTICLES INCORPORATING A FAST ALGEBRAIC CODEBOOK SEARCH TECHNIQUE

(75) Inventors: Karthik Kannan, Tamilnadu (IN); Meenakshi Sundaram Subramanian, Tamilnadu (IN)

(73) Assignee: Intel Corporation, Santa Clara, CA (US)

( * ) Notice: Subject to any disclaimer, the term of this patent is extended or adjusted under 35 U.S.C. 154(b) by 274 days.

(21) Appl. No.: 10/387,749

(22) Filed: Mar. 13, 2003

(65) Prior Publication Data

US 2004/0181400 A1 Sep. 16, 2004

(51) Int. Cl.
*G10L 19/00* (2006.01)
*G10L 21/00* (2006.01)

(52) U.S. Cl. ..... 704/219; 704/230; 704/500

(58) Field of Classification Search ..... 704/219, 704/220, 221, 223; 379/88.1
See application file for complete search history.

(56) References Cited

U.S. PATENT DOCUMENTS

| | | | | |
|---|---|---|---|---|
| 5,701,392 | A | 12/1997 | Adoul et al. | 704/219 |
| 5,717,825 | A | 2/1998 | Lamblin | 704/223 |
| 5,751,901 | A | 5/1998 | DeJaco et al. | 395/2.25 |
| 5,754,976 | A | 5/1998 | Adoul et al. | 704/223 |
| 5,924,062 | A * | 7/1999 | Maung | 704/219 |
| 5,970,444 | A * | 10/1999 | Hayashi et al. | 704/223 |
| 6,055,496 | A | 4/2000 | Heidari et al. | 704/222 |
| 6,330,531 | B1 * | 12/2001 | Su | 704/204 |
| 6,393,390 | B1 | 5/2002 | Patel et al. | 704/207 |
| 6,393,391 | B1 | 5/2002 | Ozawa | 704/219 |
| 6,421,639 | B1 | 7/2002 | Yasunaga et al. | 704/223 |
| 6,470,313 | B1 | 10/2002 | Ojala | 704/223 |
| 6,556,956 | B1 * | 4/2003 | Hunt | 702/188 |
| 6,847,929 | B2 * | 1/2005 | Bernard | 704/223 |
| 2002/0095284 | A1 * | 7/2002 | Gao | 704/219 |
| 2003/0033136 | A1 * | 2/2003 | Lee | 704/2 |
| 2003/0046067 | A1 * | 3/2003 | Gradl | 704/217 |
| 2003/0078771 | A1 * | 4/2003 | Jung et al. | 704/222 |
| 2005/0065785 | A1 * | 3/2005 | Bessette | 704/211 |

OTHER PUBLICATIONS

Amada et al., "CELP speech coding based on an adaptive pulse position codebook", ICASSP '99, Proceedings, vol. 1, Mar. 15-19, 1999, pp.13-16, vol. 1.*

Byun et al., "A fast ACELP codebook search method", 6th International Conference on Signal Processing, Aug. 26-30, 2002, pp. 422-425 vol. 1.*

Chen et al., "Maximum-take-precedence ACELP: a low complexity search method", International Conference on Acoustics, Speech, and Signal Processing, May 7-11, 2001, pp. 693-696 vol.2.*

(Continued)

*Primary Examiner*—David Hudspeth
*Assistant Examiner*—Brian L. Albertalli
(74) *Attorney, Agent, or Firm*—Schwegman, Lundberg, Woessner & Kluth, P.A.

(57) ABSTRACT

An efficient method for codebook search, employed in speech coding, uses an optimal pulse-position grouping and a split track arrangement, based on a likelihood estimator. Also disclosed are codecs, mobile voice communication devices, telecommunications equipment and telecommunications methods.

15 Claims, 15 Drawing Sheets

OTHER PUBLICATIONS

Chen et al., "Candidate scheme for fast ACELP search", Vision, Image and Signal Processing, vol. 149, Issue 1, Feb. 2002 pp. 10-16.*

Ha, "A fast search method of algebraic codebook by reordering search sequence", International Conference of Acoustics, Speech, and Signal Processing, Mar. 15-19, 1999, pp. 21-24 vol. 1.*

Park et al., "Efficient codebook search method for ACELP speech codecs", IEEE Workshop Proceedings: Speech Coding, Oct. 9, 2002, pp.17-19.*

Spanias, "Speech coding: a tutorial review", Proceedings of the IEEE, vol. 82, Issue 10, Oct. 1994 pp. 1541-1582.*

* cited by examiner

| TRACK | PULSE | POSITIONS |
|---|---|---|
| T0 | $i_0, i_5$ | 0,5,10,15,20,25,30,35 |
| T1 | $i_1, i_6$ | 1,6,11,16,21,26,31,36 |
| T2 | $i_2, i_7$ | 2,7,12,17,22,27,32,37 |
| T3 | $i_3, i_8$ | 3,8,13,18,23,28,33,38 |
| T4 | $i_4, i_9$ | 4,9,14,19,24,29,34,39 |

*Fig. 2*

| LEFT SUB TRACKS | PULSE POSITIONS | RIGHT SUB TRACKS | PULSE POSITIONS |
|---|---|---|---|
| T00 | 5,10,0,30 | T01 | 25,35,15,20 |
| T10 | 1,31,11,21 | T11 | 26,36,6,16 |
| T20 | 32,22,2,27 | T21 | 12,37,17,7 |
| T30 | 13,28,38,23 | T31 | 8,3,18,33 |
| T40 | 19,4,9,14 | T41 | 24,29,34,39 |

*Fig. 3*

| PULSE | ASSIGNED SUB TRACKS |
|---|---|
| $i_0$ | T20 |
| $i_1$ | T30 |
| $i_2$ | T40 |
| $i_3$ | T00 |
| $i_4$ | T10 |
| $i_5$ | T21 |
| $i_6$ | T31 |
| $i_7$ | T41 |
| $i_8$ | T01 |
| $i_9$ | T11 |

APPARATUS, METHODS AND ARTICLES INCORPORATING A FAST ALGEBRAIC CODEBOOK SEARCH TECHNIQUE

TECHNICAL FIELD OF THE INVENTION

The present invention relates generally to telecommunications, and more particularly to methods and devices using algebraic codebook search techniques.

BACKGROUND OF THE INVENTION

One common objective of communication technology is to transmit information using a minimum number of bits, without losing important intelligence, by removing the redundancies in the original information. In the wireline/wireless speech communication field, advancements in speech compression have resulted in compression ratios of 1:10 or better. This compression is typically implemented using speech codecs (encoder and decoder) that use signal transformations. However, these transformations also increase the processing complexity required to encode and decode voice signals. This complexity can add a significant cost to enhancements providing higher channel density on an existing backbone. Hence, in practice, there is a trade-off between the computation complexity (based on the compression technique) and degradation in speech quality.

The Code-Excited-Linear-Prediction (CELP) is one of the techniques used in speech codecs that currently offers an optimal performance in the quality-complexity space. Several alternate realizations of CELP have been brought forward such as Algebraic CELP (ACELP), Qualcomm CELP (QCELP), Relaxed CELP (RCELP), and others, with varying degrees of complexity. Currently, the ACELP realization is widely used, since it avoids the larger memory requirements of CELP. ACELP aims at searching the best codebook excitation vector by minimizing the Mean Square Error (MSE) or maximizing the correlation between the weighted speech signal and the weighted synthesized speech signal.

In typical ACELP codec standards such as ITU-T G.729A/B, GSM-EFR, GSM-AMR, TIA/EIA-EVRC the maximum complexity lies in a single place—the random excitation codebook search, which may be up to one third of a codec encoder operational capacity. Accordingly, reduction of the complexity of a codebook search can significantly increase the capacity of a codec without adding cost.

BRIEF DESCRIPTION OF THE DRAWINGS

FIGS. 2, 3 and 4 illustrate an example of an optimized grouping of pulse positions in tracks and a data structure thereof.

FIGS. 5–9 illustrate yet other example embodiments of a method according to the present invention.

DETAILED DESCRIPTION OF THE INVENTION

In the following detailed description of the embodiments of the invention, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims.

Various embodiments of the invention described below are shown as the invention can be implemented in a GSM Adaptive MultiRate (AMR) Codec. The invention, however, is in no way limited to GSM AMR codecs, but can be homogeneously extended to other ACELP codecs such as G.729A/B, Enhanced Full Rate (EFR), and Enhanced Variable Rate Coding (EVRC). In the described example embodiments, the objective of the search technique is to select the best pair of pulses from each of the 5 tracks (totally 10 pulses) using the MSE criteria.

Figure 1:
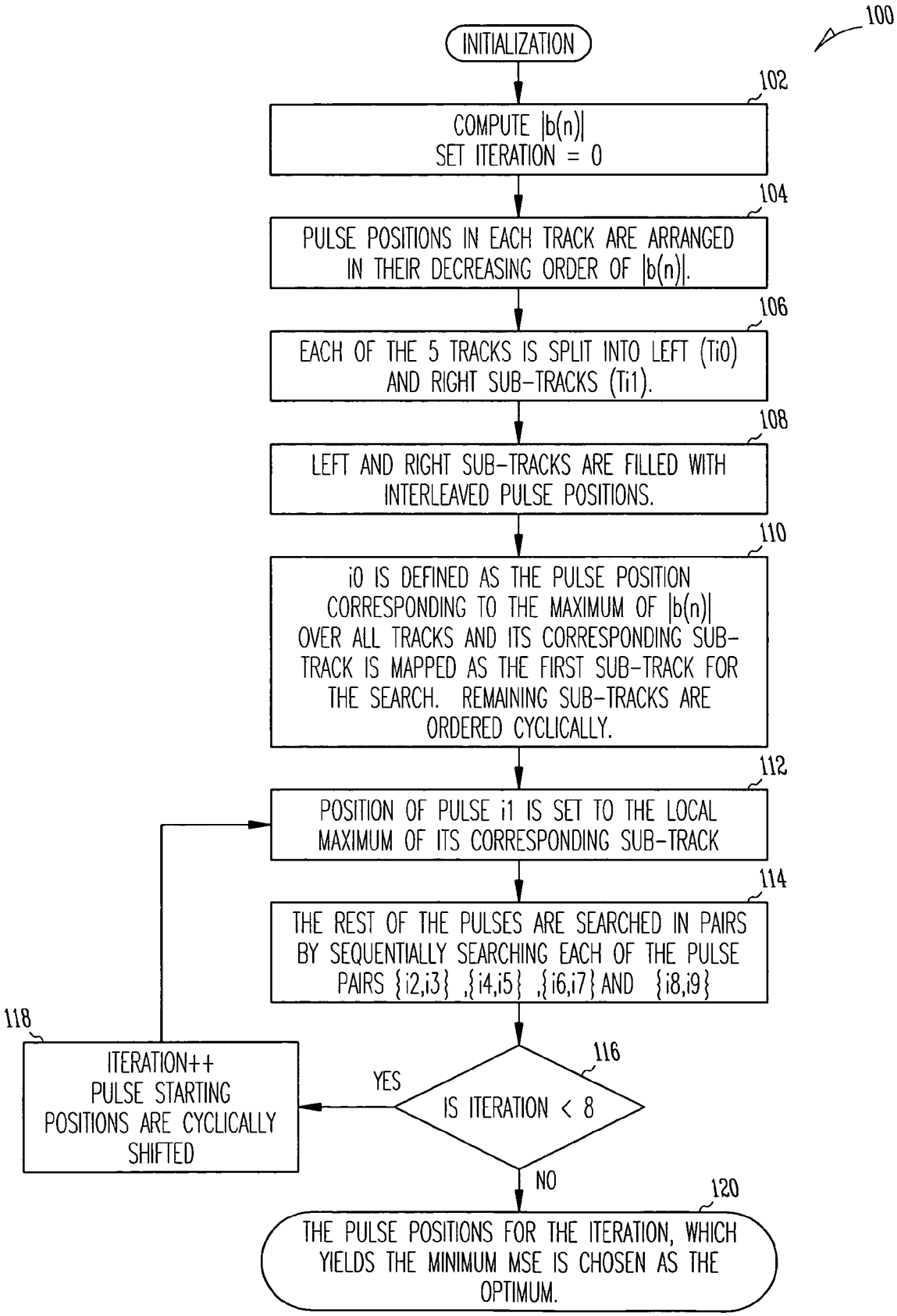
FIG. 1 illustrates an embodiment of the present invention.

Referring now to FIG. 1, there is illustrated a first example embodiment of a method 100 according to the present invention. At 102, the likelihood estimator, absolute magnitude $|b(n)|$ of a signal b(n), is computed in an Algebraic Code-Excited-Linear-Prediction (ACELP) encoding/decoding process or device. At 104 pulse positions are arranged in each track in the descending order of the computed $|b(n)|$. At 106, the tracks are split into left (Ti0) and right (Ti1) sub-tracks. At 108, the left and right sub-tracks are filled with interleaved pulse positions. At 110, i0 is defined as the pulse position corresponding to the maximum of $|b(n)|$ over all tracks and its corresponding sub-track is mapped as the first sub-track for a codebook search, and the remaining sub-tracks are ordered cyclically. At 112, the position of pulse i1 is set to the local maximum of its corresponding sub-track. At 114, the rest of the pulses are searched in pairs by sequentially searching each of the pulse pairs {i2,i3}, {i4,i5}, {i6,i7}, {i8,i9}. At 116, 118 the searching is reiterated wherein the pulse starting positions are cyclically shifted. At 120, the pulse positions for the iteration that yields the minimum mean square error (MSE) as the optimum are chosen.

Figures 4, 5:
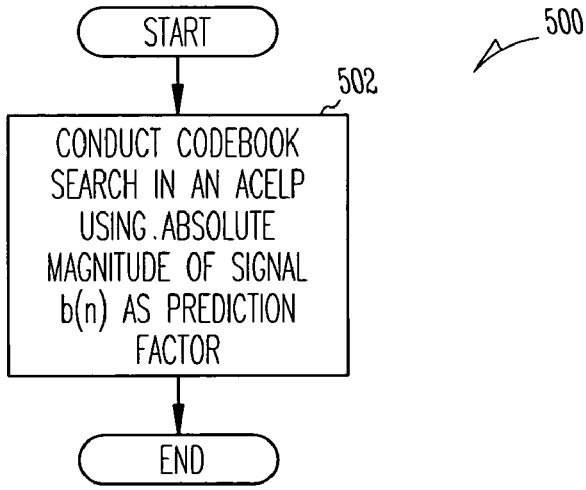

Referring to FIG. 2, there is illustrated an ACELP codebook structure arranged in Interleaved Single Pulse Permutation (ISPP) layout for AMR. In FIG. 3, there is illustrated an example of an optimized grouping of pulse positions pursuant to the example embodiment illustrated in FIG. 1. Note in T00, $|b(5)|>|b(10)|>|b(0)|>|b(30)|$. In FIG. 4, there is illustrated an example assignment of sub-tracks to pulses if the first sub-track is T20, according to the example embodiment of the invention illustrated in FIG. 1.

Referring to FIG. 5, there is illustrated another example embodiment 500 of a method according to the present invention. At 502, method 500 provides for conducting a random excitation codebook search in an Algebraic Code-Excited-Linear-Prediction (ACELP) codec using the absolute magnitude of a signal b(n) as a prediction factor for determining the optimum pulse position.

Figure 6:
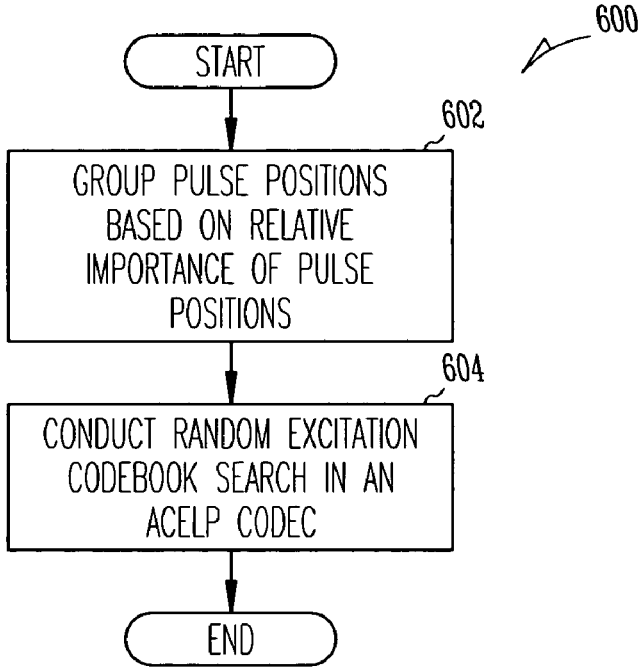

Referring to FIG. 6, there is illustrated another example embodiment 600 of the invention. At 602, this example embodiment provides for grouping pulse positions based on relative importance of the pulse positions for the purpose of conducting a random excitation codebook search in an Algebraic Code-Excited-Linear-Prediction (ACELP) codec. According to still another alternate embodiment, at 602 embodiment 600 optionally includes grouping pulse positions to provide a grouping that is at least partially optimized for a codebook search. According to still another example embodiment, pulse positions are grouped using the absolute magnitude of a signal b(n) as a prediction factor for determining the optimum grouping.

Figure 7:
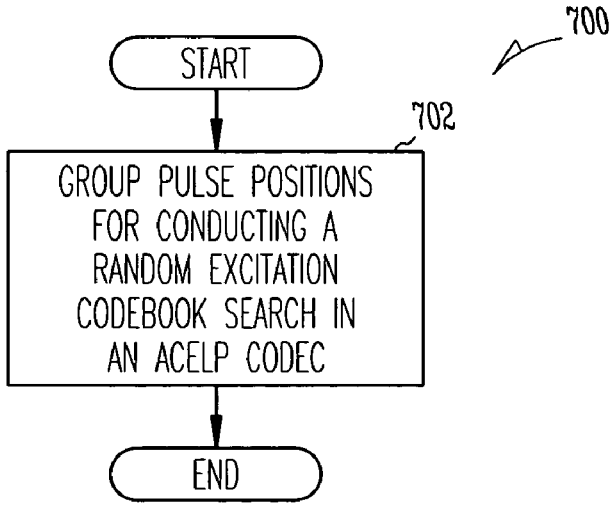

Referring to FIG. 7, there is illustrated another example embodiment 700 of the invention. At 702, this example embodiment provides for grouping pulse positions for the purpose of conducting a random excitation codebook search in an Algebraic Code-Excited-Linear-Prediction (ACELP) codec, wherein the pulse positions are grouped in a plurality of groups of number A and the pulse code combinations in one of the groups is less than the number of pulse code combinations in a group if the pulse positions are grouped in a plurality of groups of number G, wherein A is greater than G, and further wherein the pulses are grouped in the plurality of groups A according to an algorithm that increases the chances that a codebook search of the groups A will yield an optimum result that is better than if the pulses are arbitrarily grouped.

Figure 8:
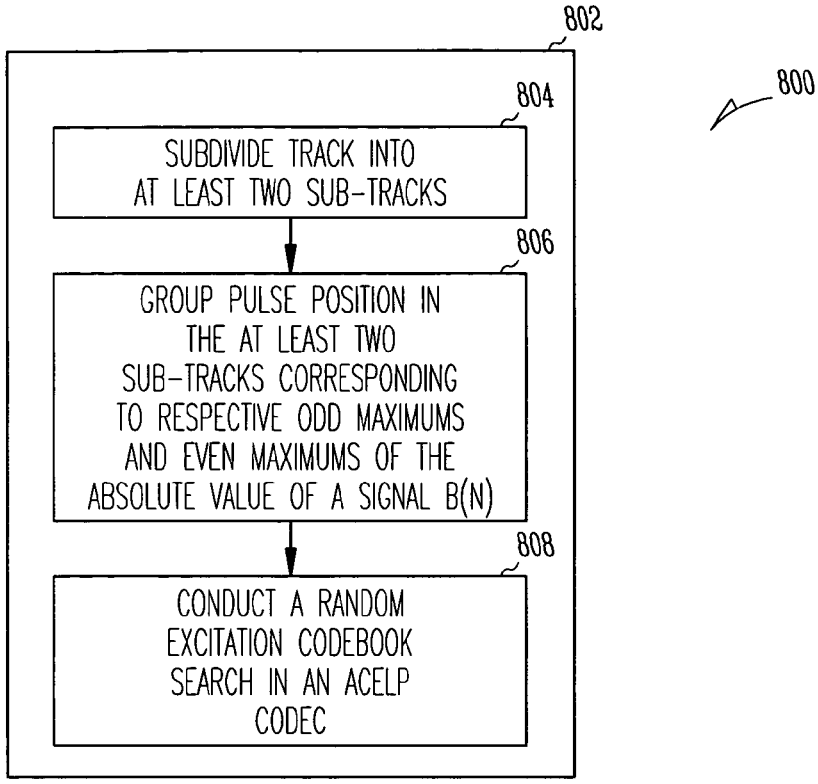

Referring to FIG. 8, there is illustrated another example embodiment 800 of the invention. At 802, this example embodiment provides for conducting a random excitation codebook search in an Algebraic Code-Excited-Linear-Prediction (ACELP) codec using one or more tracks of pulse positions, wherein at least one of the tracks is subdivided into at least two sub-tracks and pulse positions are grouped in the at least two sub-tracks corresponding to respective odd maximums and even maximums of the absolute value of a signal b(n). According to still another example embodiment, at 802 embodiment 800 optionally provides for grouping of pulses in the sub-tracks to attempt to evenly distribute the contributions of pulse positions between the sub-tracks. According to yet another example embodiment, embodiment 800 optionally provides that the number of tracks is five (5) and the number of sub-tracks is two (2), and the number of pulse positions in each sub-track is four (4).

Figure 9:
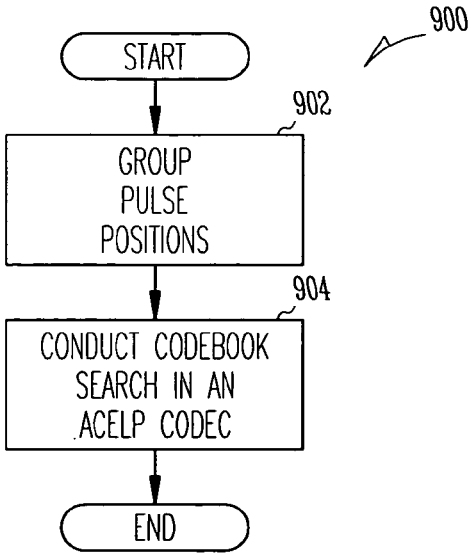

Referring to FIG. 9, there is illustrated still yet another example embodiment 900 of the invention. At 902, this example embodiment provides for grouping pulse positions to improve the chances that a codebook search of the resulting combinations of pulse positions will yield an acceptable result, wherein the method is performed in an Algebraic Code-Excited-Linear-Prediction (ACELP) codec. According to an optional alternate embodiment, an acceptable result is one that produces signal degradation that is not perceptual to a human listener. According to still another alternate embodiment of embodiment 900, the grouping of pulse positions is determined according to an optimization algorithm.

Figure 10:
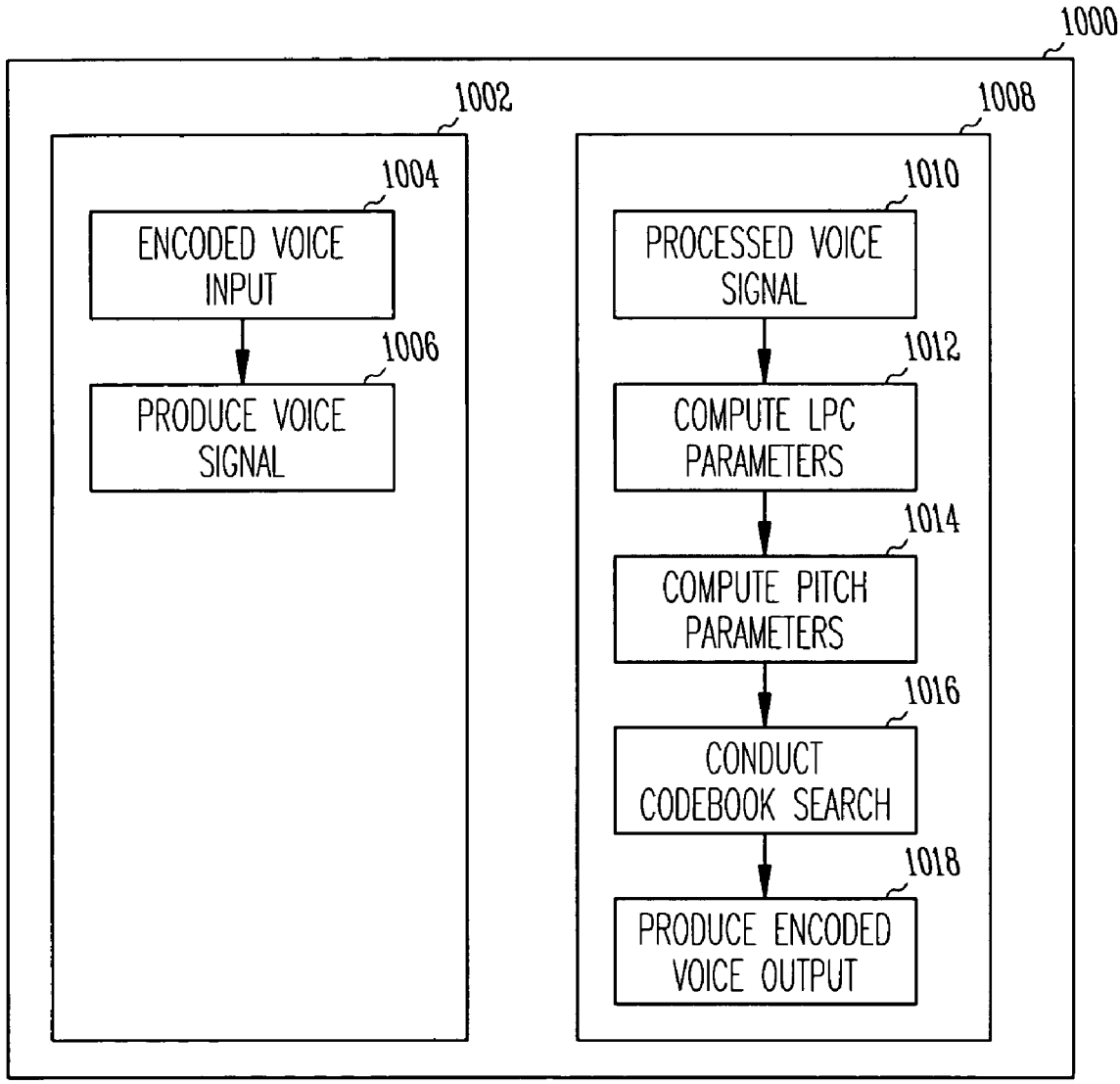
FIG. 10 illustrates a codec according to yet another example embodiment of the invention.

Referring to FIG. 10, there is illustrated a codec 1000 according to yet another example embodiment of the invention. Codec 1000 includes a decoder unit 1002 producing a voice signal 1006 in response to an encoded voice input 1004. The codec 1000 further includes an encoder unit 1008 for producing an encoded voice output 1018. The encoder unit 1008 receives the processed voice signal 1010 and computes a set of LPC (Linear Predicting Code) parameters 1012. The encoder unit 1008 further computes pitch parameters 1014, and conducts an algebraic codebook search 1016 in accordance with any one of the above-described example methods illustrated in FIGS. 1–9 and produces an encoded voice output 1018. According to one example embodiment, codec 1000 is implemented in hardware, software or a combination thereof.

Figure 11:
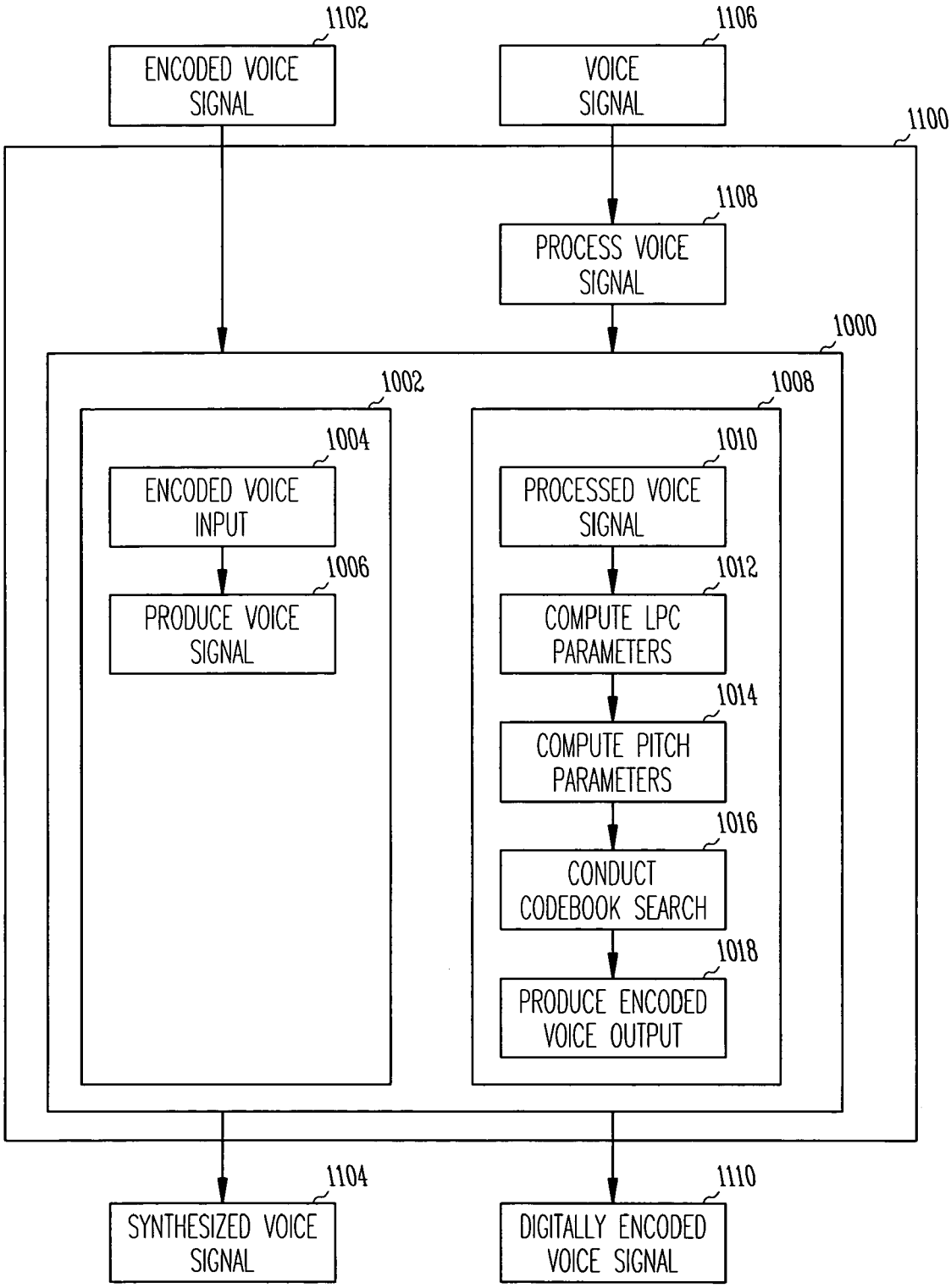
FIG. 11 illustrates an example embodiment of a voice communication device including a codec according to the present invention.

Referring now to FIG. 11, there is illustrated an example embodiment of a voice communication device 1100. Voice communication device 1100 receives a voice signal 1106 (in either analog or digital form) and processes the voice signal 1108 for input to codec 1000 (fed as an input to encoder unit 1008). Codec 1000 produces encoded voice signal, in digital form 1110, for transmission through a carrier medium or system to another voice communication device. Further, the codec 1000 also receives an encoded voice signal 1102 (fed as an input to decoder unit 1002) from the transmission medium and outputs a synthesized voice signal 1104.

Figure 12:
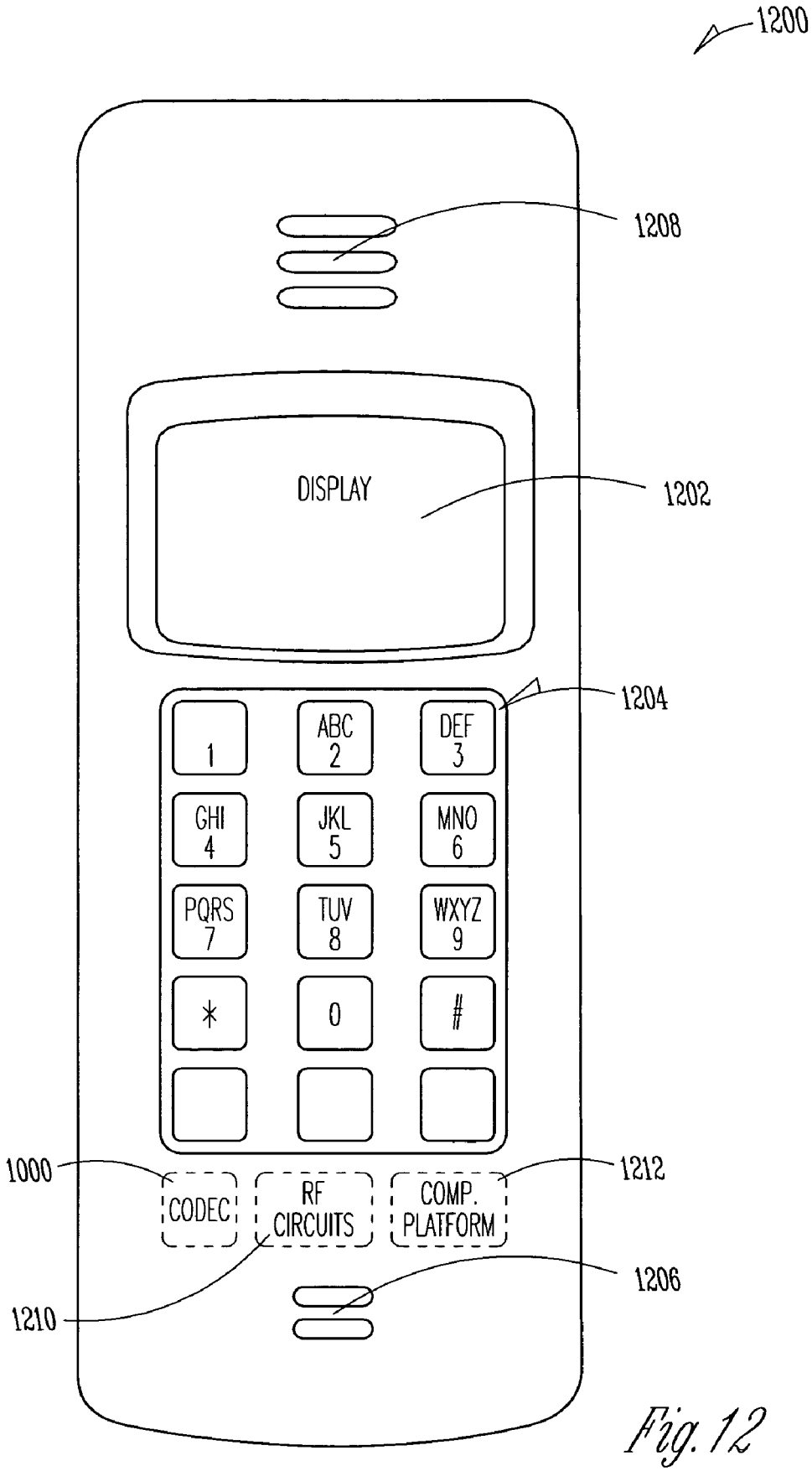
FIGS. 12, 13 and 14 illustrate various example embodiments of the invention including a mobile telephone, a wireline phone and a personal computer.
Figure 13:
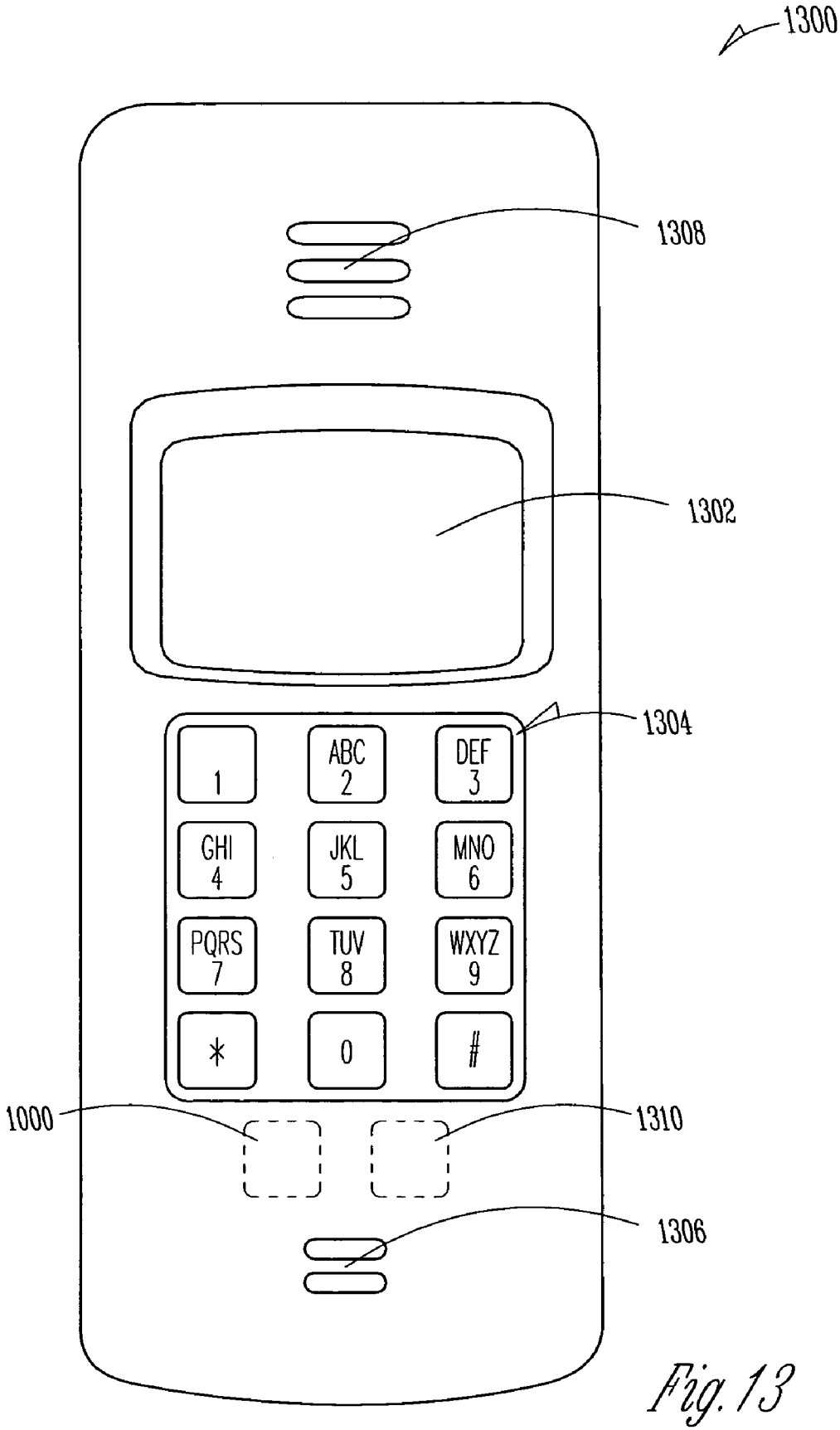
Figure 14:
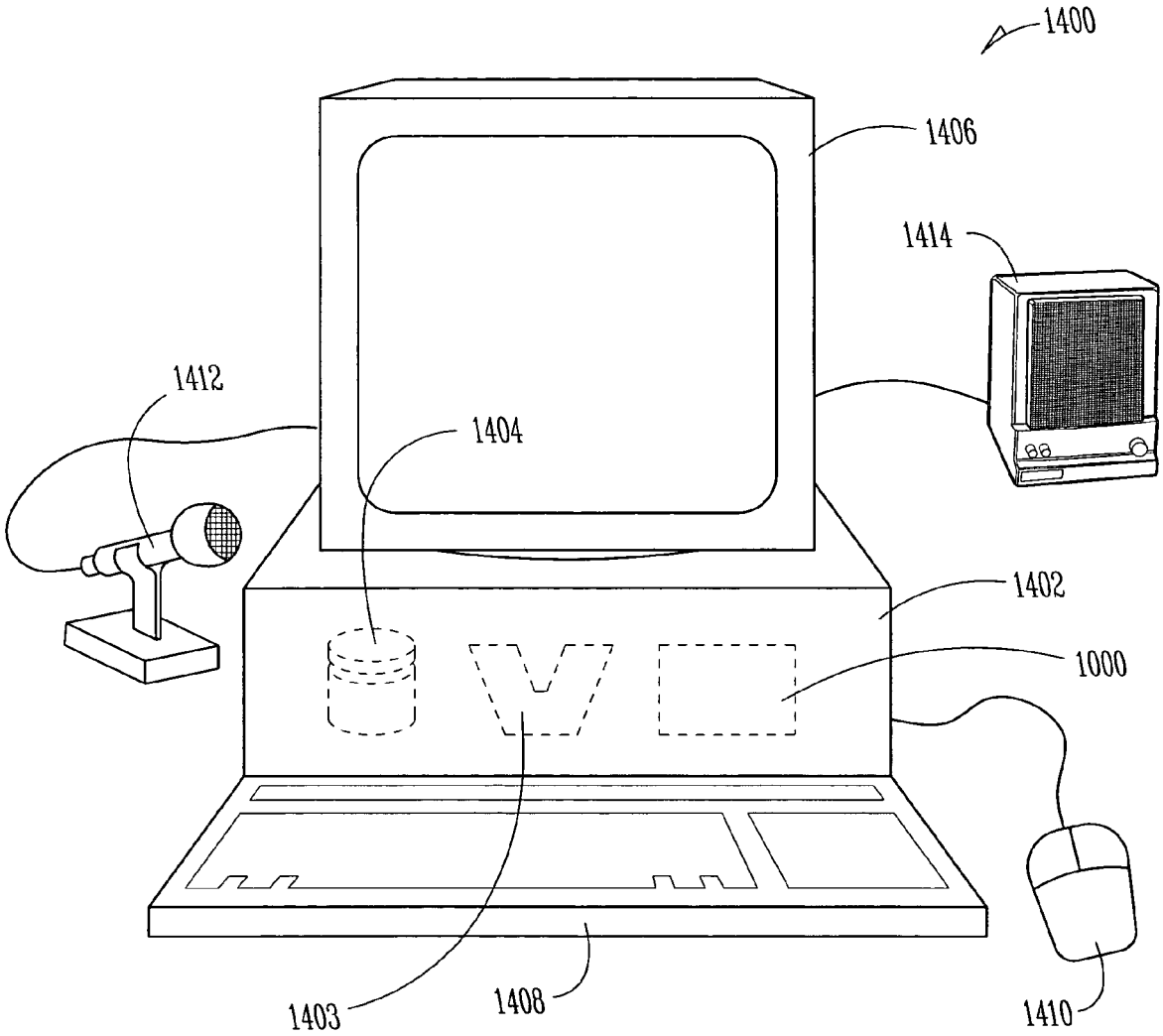

Referring now to FIGS. 12, 13 and 14, a voice communication device 1100 is, in various example embodiments, implemented in a mobile telephone or combination PDA and mobile telephone 1200, as shown in FIG. 12, a wireline phone 1300 as shown in FIG. 13, a personal computer 1400 as shown in FIG. 14, or any combination of the above, by way of illustration but not by way of limitation. For example, as shown in FIG. 12, mobile telephone and optionally PDA 1200 includes a display 1202, keypad 1204, microphone 1206, speaker 1208, a codec 1000, RF circuits 1210 for communicating with a wireless base station, and optionally a computing platform 1212 having a computing device and operating system and application software. As shown in the example embodiment of FIG. 13, a wireline phone 1300 optionally includes a display 1302, a keypad 1304, microphone 1306, speaker 1308, a codec 1000, and optionally a computing device 1310 to implement telephone functions. As illustrated in FIG. 14, a personal computer 1400 includes a computing platform 1402 including a processing unit, a storage medium 1404 for storing operating system software and application software, a display device 1406, a keyboard 1408, a mouse input device 1410, a microphone 1412, a speaker(s) 1414 and a codec 1000.

Figure 15:
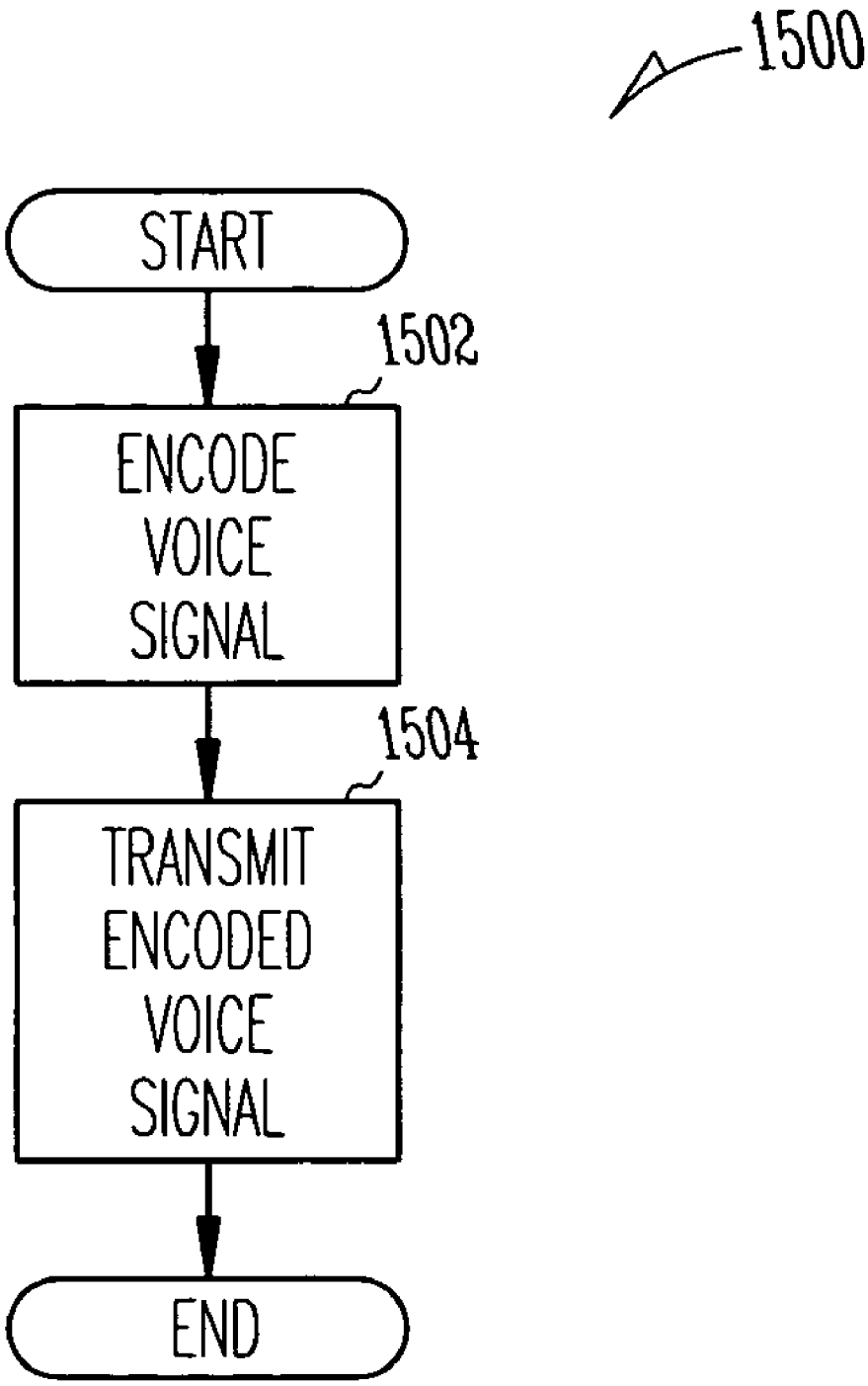
FIG. 15 illustrates an example method of transmitting an encoded voice signal.

Referring now to FIG. 15, there is illustrated a method 1500 of transmitting an encoded voice signal derived using any example embodiment of the methods of the invention, including, at 1502, encoding a voice signal using one the example methods of FIGS. 1–9, and at 1504 transmitting the encoded signal over a transmission medium such as a wireline, an RF transmission medium, a circuit switched network, a packet switched network, or any other medium. Such encoding may occur in a wireless base station or any other network equipment.

Referring now again to FIGS. 3–4, one example embodiment of the invention provides for a data structure stored in a data storage medium wherein the data structure provides for representing tracks of pulse positions split into left (Ti0) and right (Ti1) sub-tracks, and further wherein the left and right sub-tracks are filled with interleaved pulse positions. Optionally, the sub-tracks are populated with pulse positions per any one of the methods described hereinabove.

Figure 16:
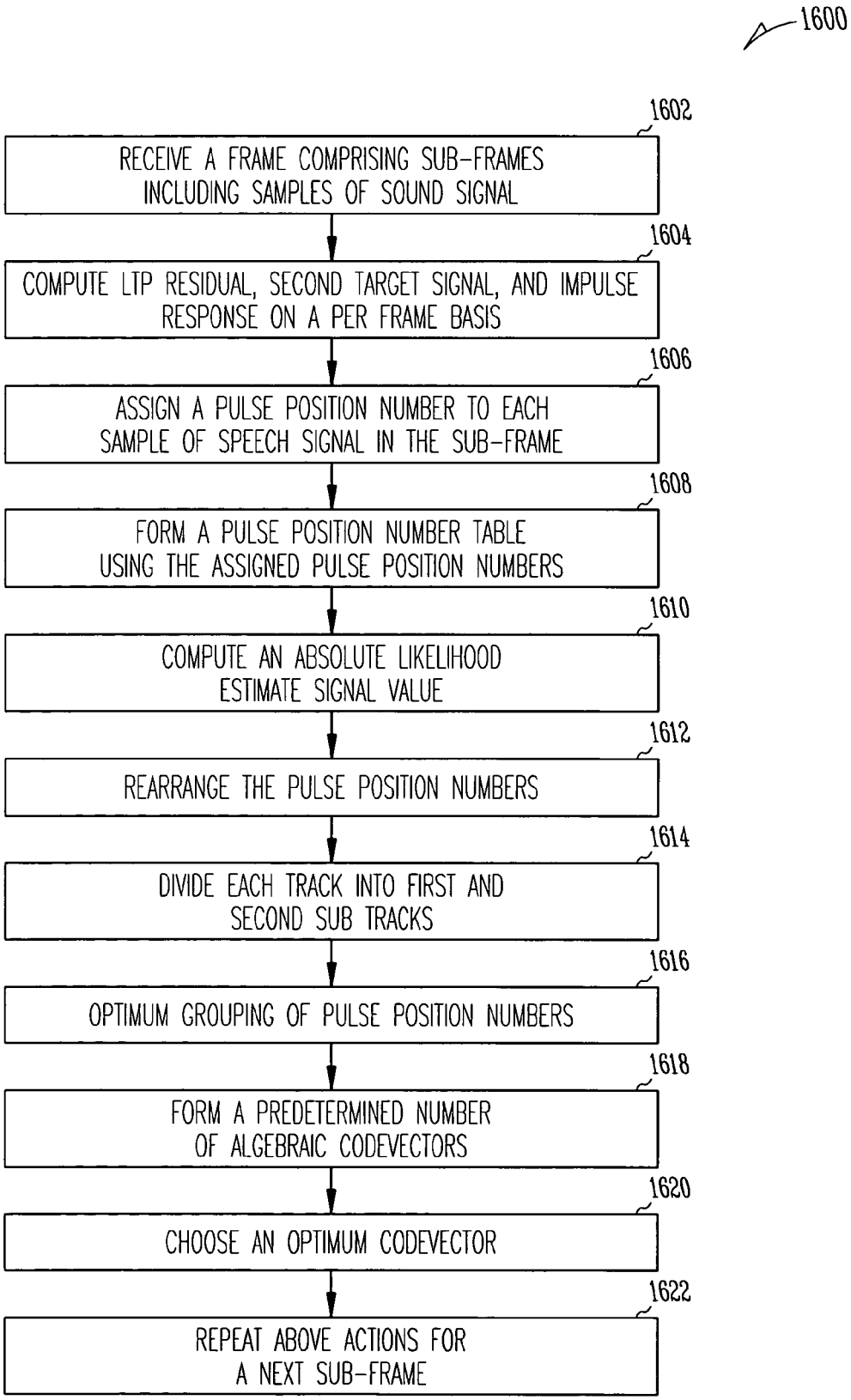
FIGS. 16 and 17 illustrate yet other example embodiments of the invention.

Referring now to FIG. 16, there is illustrated an example embodiment of a method 1600 for processing a speech signal according the invention. At 1602, a frame comprising sub-frames is received including samples of sound signal. At 1604, computing is performed on a per frame basis to compute LTP (Long-Term Prediction) residual, a second target signal, and an impulse response. At 1606, a pulse position number is assigned to each sample of a speech signal in the sub-frame. At 1608 a pulse position number table is formed using the assigned pulse position numbers. AT 1610, an absolute likelihood estimate signal value is computed. At 1612, the pulse position numbers are rearranged. At 1614, each track is divided into first and second sub-tracks. At 1616, pulse position numbers are optimally grouped. At 1618, a predetermined number of algebraic code vectors are formed. At 1620, an optimum code vector is chosen. This process is then repeated for a next sub-frame.

Figure 17:
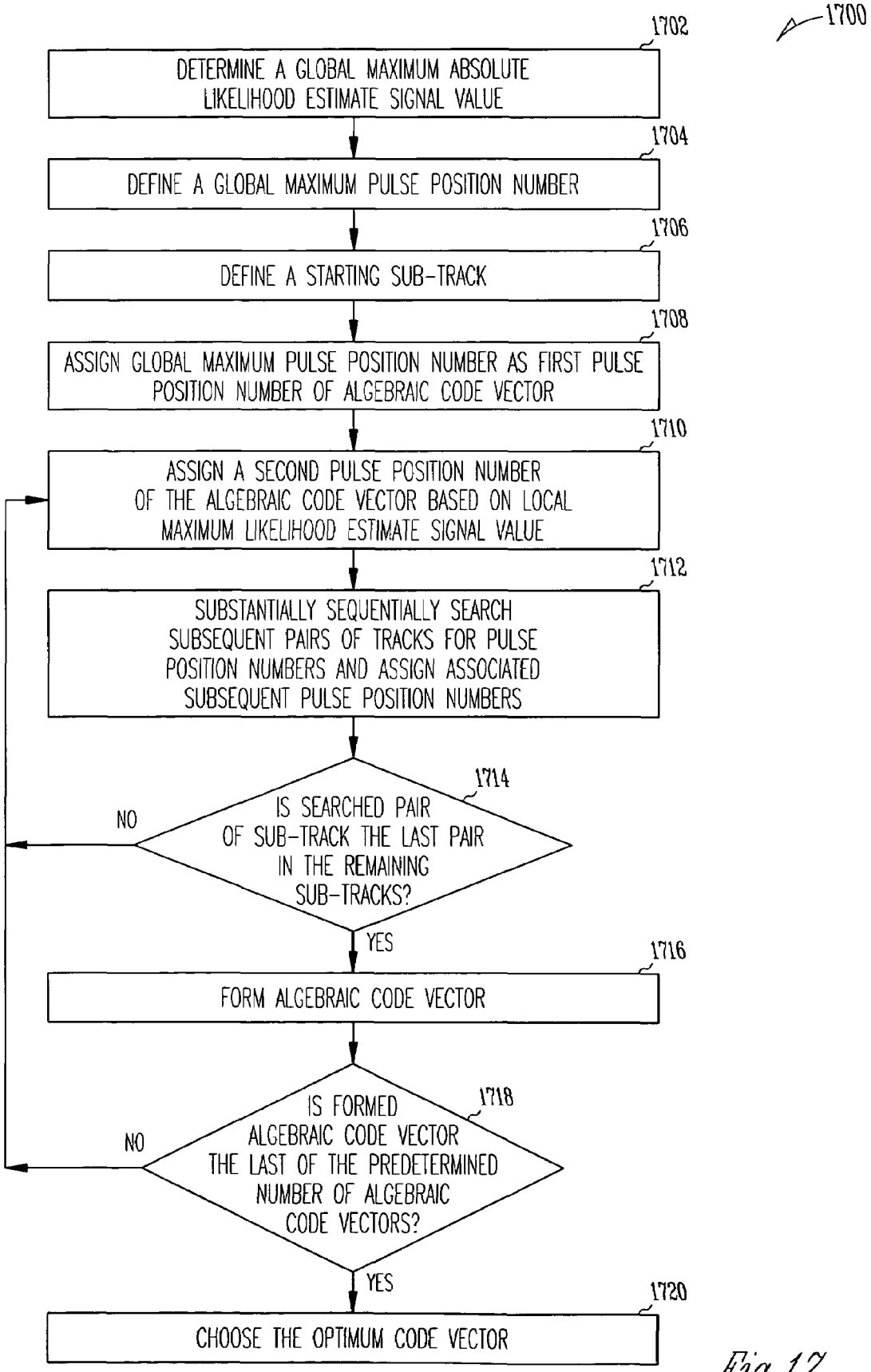

Referring now to FIG. 17, there is illustrated yet another example embodiment of a method 1700 according to the present invention. At 1702, there is determined a global maximum absolute likelihood estimate signal value is determined. At 1704, a global maximum pulse position number is defined. At 1706, a starting sub-track is defined. At 1708, a global maximum pulse position number as first pulse position number of algebraic code vector is assigned. At 1710, a second pulse position number of the algebraic code vector based on local maximum likelihood estimate signal value is assigned. At 1712, subsequent pairs of tracks for pulse position numbers are substantially sequentially searched and associated subsequent pulse position numbers are assigned. At 1714, a determination is made if a searched pair of sub-tracks is the last pair in the remaining sub tracks. If so, at 1716, an algebraic codevector is formed. At 1718, a determination is made if the formed algebraic codevector is the last of the predetermined number of algebraic code vectors. If so, 1720 at optimum code vector is chosen.

Figure 18:
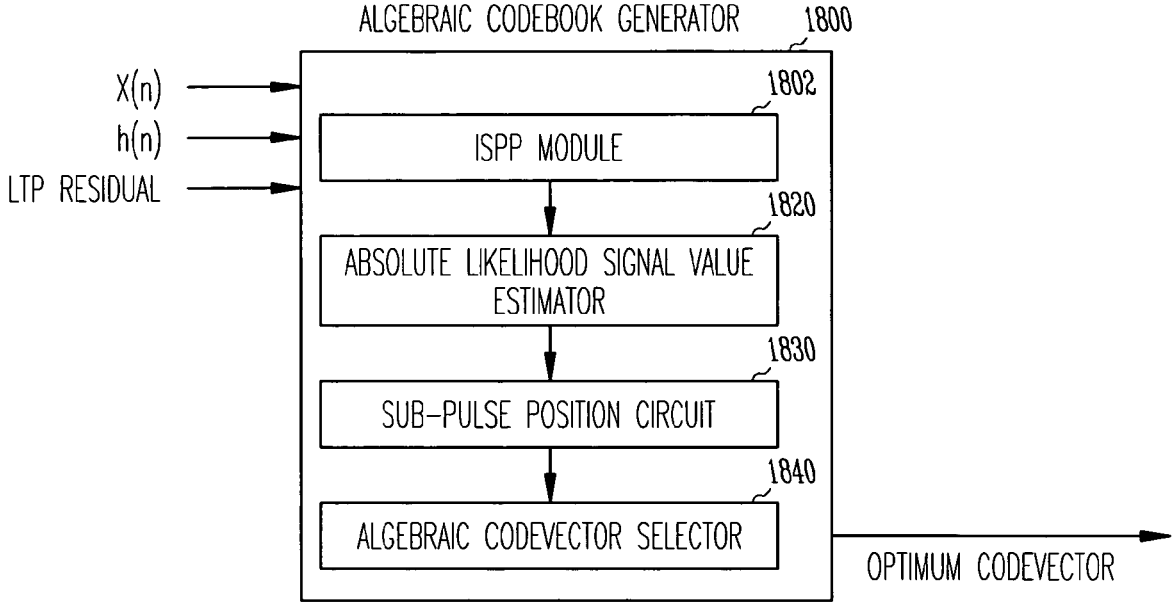
FIG. 18 illustrates a codebook generator according to one example embodiment of the invention.

Referring now to FIG. 18, there is illustrated yet another example embodiment of a codebook generator 1800 according to the present invention. Generator 1800 receives input signals X(n), h(n) and LTP Residual. The generator 1800 includes an ISPP module 1802, an absolute likelihood signal value estimator 1820, a sub-pulse position circuit 1830 and an algebraic codevector selector 1840. Generator 1800 produces an optimum codevector signal.

Figure 19:
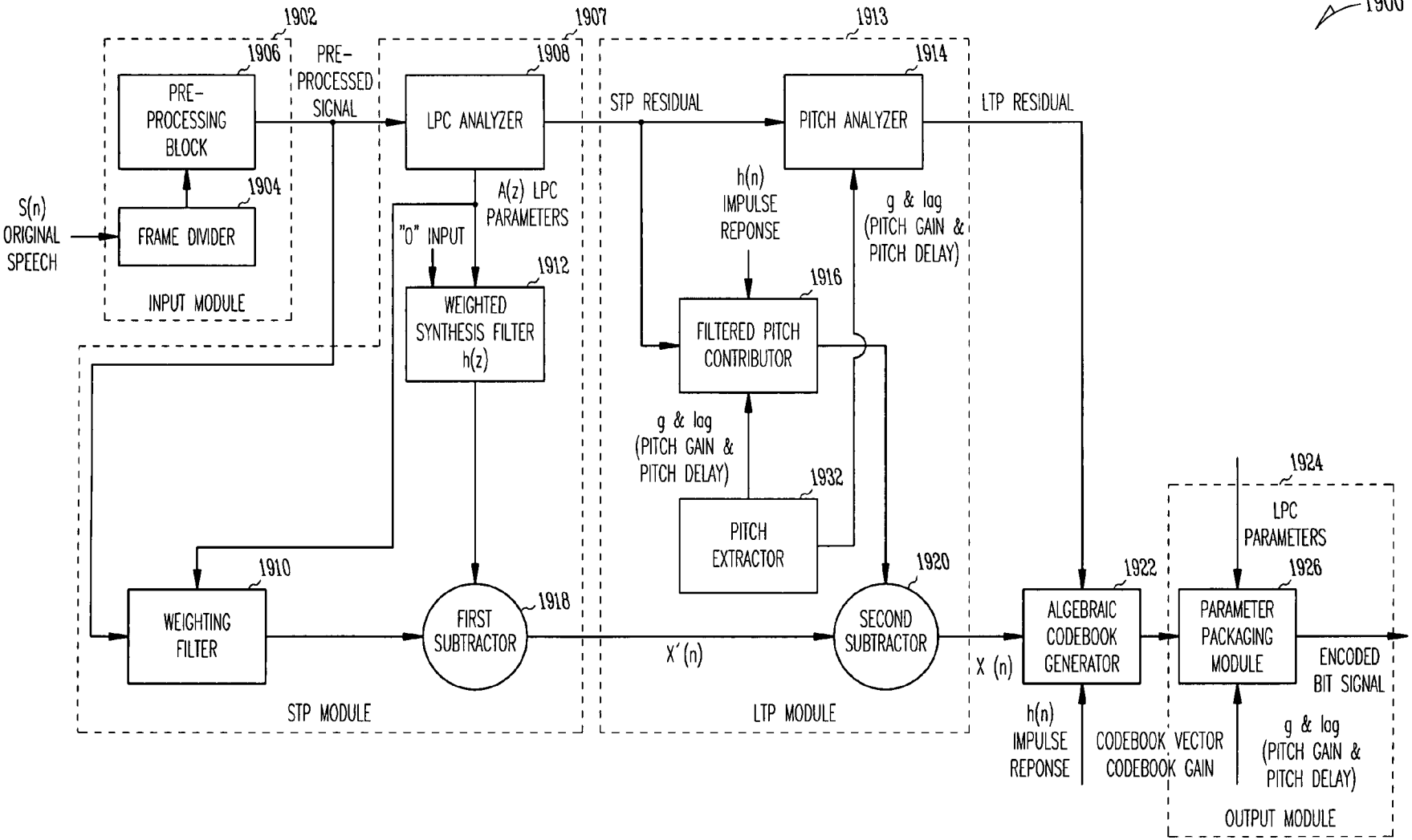
FIG. 19 illustrates an encoding device according to still yet another example embodiment of the invention.

Referring now to FIG. 19, there is illustrated an example embodiment of a codec voice-encoding unit 1900 according to the invention. The voice-encoding unit 1900 is based on analysis by Synthesis (AbS) method. A speech signal s(n) is received at an input module 1902, at a frame divider 1904. Frames are delivered to pre-processing block 1906, which are high-pass filtered in the pre-processing block 1906 and a pre-processed signal is outputted to an STP (Short-Term Prediction) module 1907. The pre-processed signal is received at an LPC analyzer 1908 and performs an LPC analysis on each received frame to compute Linear Prediction (LP) coefficients. The LP coefficients are then converted to Line Spectrum Pairs (LSP). The excitation signal is chosen by using the AbS search procedure in which the error between the original speech and the reconstructed speech is minimized according to a perceptually weighted distortion measure. The excitation parameters, algebraic and pitch parameters, are determined for each sub-frame. A first subtractor 1918 then computes a first target signal x'(n) by subtracting a zero input response of weighted synthesis filter H(z) outputted by a weighting filter unit 1910 and a weighted speech signal outputted by a weighting filter 1910. LTP module 1913 then receives the first target signal x'(n). The LTP module 1913 then computes an impulse response h(n) of the weighted synthesis filter. A pitch extractor 1918 then extracts pitch delay lag and pitch gain g using the first target signal x'(n) and the impulse response h(n) by searching around an open loop pitch delay. A second subtractor 1920 then outputs a second target signal x(n) by subtracting the filtered pitch contribution outputted by a filtered pitch contributor 1916. The second target signal x(n) is received at codebook generator 1922, along with an impulse response signal h(n) to find an optimum codebook. The optimum codebook is fed to an output module 1924, which includes a parameter packaging module 1926, which receives an LPC parameters signal the codebook output vector and codebook gain g pitch gain and pitch delay signal, and produces an encoded bit signal.

The various embodiments of the codec and methods of encoding described herein are applicable generically to any ACELP codec, and the embodiments described herein are in no way meant to limit the applicability of the invention. In addition, the techniques of the various example embodiments are useful the design of speech processing DSP architectures, any hardware implementations of speech codecs, software, firmware and algorithms. Accordingly, the methods and apparatus of the invention are applicable to such applications and are in no way limited to the embodiments described herein.

Further, as described above, various example embodiments of the invention provide for reducing the complexity of codebook searches while attempting to minimize effect on perceptual speech quality. A reduction in the complexity in codebook searches, for example, potentially saves MIPS in the implementation on any general purpose DSP. Such MIPS savings may be used, for instance, to improve the channel density of the codec on an existing communication network backbone.

The invention claimed is:

1. A method comprising conducting a random excitation codebook search in an Algebraic Code-Excited-Linear-Prediction (ACELP) codec, wherein the random excitation codebook search in the ACELP codec is conducted by grouping pulse positions based on relative importance of pulse positions as a function of an absolute value |b(n)| of a telecommunication signal b(n) and wherein pulse positions of at least one group are divided into at least two sub-groups corresponding to respective odd maximums and even maximums of the absolute value of the signal b(n).

2. A method according to claim 1 further including grouping pulse positions in sub-tracks.

3. A method according to claim 1 further including selecting a codebook vector from the codebook.

4. A method according to claim 1 further including grouping pulse positions based to provide grouping that is at least partially optimized for a codebook search.

5. A method according to claim 1 wherein pulse positions are grouped using the absolute magnitude of a signal b(n) as a prediction factor for determining the optimum grouping.

6. A method according to claim 1 wherein pulses are grouped in tracks.

7. A method according to claim 6 wherein pulses are grouped in sub-tracks.

8. A method comprising grouping pulse positions for the purpose of conducting a random excitation codebook search in an Algebraic Code-Excited-Linear-Prediction (ACELP) codec, wherein the pulse positions are grouped in a plurality of subtracks of number A and the pulse code combinations in a group is less than the number of pulse code combinations in the subtracks A if the pulse positions are grouped in a plurality of groups of number G wherein A is greater than G, and further wherein the pulses are grouped in the plurality of subtracks A according to an algorithm that increases the chances that a codebook search of the subtracks A will yield an optimum result that is better than if the pulses are arbitrarily grouped, wherein the algorithm includes grouping pulse positions corresponding to respective odd maximums and even maximums of an absolute value of a telecommunications signal b(n).

9. A method according to claim 8 further including selecting a codebook vector from the codebook.

10. A method comprising conducting a random excitation codebook search in an Algebraic Code-Excited-Linear-Prediction (ACELP) codec using one or more tracks of pulse positions, wherein at least one of the tracks is subdivided into at least two sub-tracks and pulse positions are grouped in the at least two sub-tracks corresponding to respective odd maximums and even maximums of the absolute value of a signal b(n).

11. A method according to claim 10 further wherein the grouping of pulses in the sub-tracks evenly distributes the contributions of pulse positions between the sub-tracks.

12. A method according to 10 further wherein the number of tracks is 5 and the number of sub-tracks is 2, and the number of pulse positions in each sub-track is 4.

13. A method comprising grouping pulse positions to increase the likelihood that a codebook search of the resulting combinations of pulse positions will yield an acceptable result, wherein the method is performed in an Algebraic Code-Excited-Linear-Prediction (ACELP) codec, wherein the pulse positions are grouped based on relative importance of pulse positions as a function of an absolute value $|b(n)|$ of a telecommunication signal b(n), further wherein the pulse positions are grouped into at least two sub-groups corresponding to respective odd maximums and even maximums of the absolute value of the telecommunication signal b(n).

14. A method according to claim 13 further wherein an acceptable result is one that produces signal degradation that is not perceptual to a human listener.

15. A method according to claim 13 further wherein the grouping of pulse positions is determined according to an optimization algorithm.

* * * * *

UNITED STATES PATENT AND TRADEMARK OFFICE

CERTIFICATE OF CORRECTION

PATENT NO. : 7,249,014 B2
APPLICATION NO. : 10/387749
DATED : July 24, 2007
INVENTOR(S) : Kannan et al.

It is certified that error appears in the above-identified patent and that said Letters Patent is hereby corrected as shown below:

In column 7, line 17, in Claim 12, delete "10" and insert -- claim 10 --, therefor.

Signed and Sealed this

Sixteenth Day of October, 2007

JON W. DUDAS
*Director of the United States Patent and Trademark Office*